US005499940A

United States Patent [19]

Johnson et al.

[11] Patent Number: 5,499,940

[45] Date of Patent: Mar. 19, 1996

[54] FLUID POWERING AND LAUNCHING SYSTEM FOR A TOY VEHICLE

[75] Inventors: Lonnie G. Johnson, Smyrna; John T. Applewhite, Atlanta, both of Ga.

[73] Assignee: Johnson Research and Development Company, Inc., Smyrna, Ga.

[21] Appl. No.: 197,511

[22] Filed: Feb. 16, 1994

[51] Int. Cl.[6] ..... A63H 33/40; A63H 3/31; A63H 29/00

[52] U.S. Cl. ..... 446/180; 446/194; 446/429

[58] Field of Search ..... 446/180, 176, 446/188, 189, 194, 195, 196, 211, 212, 429, 431, 435, 440, 457, 462

[56] References Cited

U.S. PATENT DOCUMENTS

| | | | |
|---|---|---|---|
| 1,796,157 | 3/1931 | Moore . | |
| 3,136,088 | 6/1964 | Crandall . | |
| 3,232,001 | 2/1966 | Stanzel . | |
| 3,613,303 | 10/1971 | Allen . | |
| 3,740,896 | 6/1973 | Glass et al. | 446/212 |
| 3,789,540 | 2/1974 | Convertine et al. . | |
| 3,792,549 | 2/1974 | Lemelson . | |
| 3,936,053 | 2/1976 | Goldfarb et al. | 446/180 X |
| 3,950,889 | 4/1976 | Dabney . | |
| 4,213,268 | 7/1980 | Erickson et al. | 446/180 |
| 4,329,806 | 5/1982 | Akiyama et al. . | |
| 4,373,290 | 2/1983 | Goldfarb et al. | 446/429 X |
| 4,526,554 | 7/1985 | Goldfarb et al. | 446/429 |
| 5,032,100 | 7/1991 | Goldfarb | 446/211 X |
| 5,092,808 | 3/1992 | Takasaka et al. . | |
| 5,141,467 | 8/1992 | Crosbie | 446/429 X |
| 5,154,657 | 10/1992 | Wildman et al. | 446/211 |

FOREIGN PATENT DOCUMENTS

| | | | |
|---|---|---|---|
| 2432320 | 5/1975 | Germany | 446/429 |

*Primary Examiner*—Robert A. Hafer
*Assistant Examiner*—D. Neal Muir
*Attorney, Agent, or Firm*—Michael Drew

[57] ABSTRACT

A system (10) simultaneously directs compressed fluid to a turbine while compressing fluid to disengage a locking mechanism that restrains movement of the toy vehicle (11). A primary tube (20), attached to the toy vehicle body (12), forms a primary chamber (22) which receives a plug in the form of a secondary tube (30) that seals the primary chamber (22). A fluid may be compressed into the primary chamber (22) through the inserted plug (30). The interior of the inserted tube (30) forms a secondary chamber (32) which encases a hollow piston (40). Fluid is compressed into the primary chamber (22) and secondary chamber (32) through the hollow piston (40). The hollow piston (40) also forms a part of a locking mechanism which maintains a latch (60), the primary tube (20) and the secondary tube (30) in contact with one another until pressurized fluid in the primary chamber (22) forces the piston (40) away from the latch (60). As the latch (60) disengages, pressurized fluid from the primary chamber (22) forces the secondary tube/plug (30) from the primary tube (20). The hollow piston (40), secondary tube (30) and primary tube (20) have openings which together form a pathway for fluid to pass to a turbine tube (50) on the chassis (12) of the toy vehicle (11). The turbine tube (50) directs fluid to a turbine wheel (70) which in turn is connected to flywheels (74, 90) which provide power to the wheels of the toy vehicle (11).

21 Claims, 5 Drawing Sheets

FLUID POWERING AND LAUNCHING SYSTEM FOR A TOY VEHICLE

TECHNICAL FIELD OF THE INVENTION

The present invention relates to toy vehicles such as toy cars and the like, and more particularly to a system utilizing a fluid to power and launch such toys.

BACKGROUND OF THE INVENTION

Much of the enjoyment of playing with toy vehicles such as toy cars is derived from rapidly projecting the vehicles across an area. Individuals enjoy a toy vehicle that can achieve a high rate of speed. The toy may be even more enjoyable if it can be launched easily but still achieve a high rate of speed. And, as with most toys, it is desirable that the toy vehicle be able to reliably perform over and over again.

Mechanical means for powering toys are generally reliable and economical. A compressed fluid is a means of storing mechanical energy for many purposes. Since air and many other compressible fluids are relatively inexpensive and readily obtainable it would be advantageous to have a means that utilizes air or other compressible fluids as a mechanical means to power and launch a toy vehicle. Thus, it can be appreciated that it would be highly desirable to have a means for utilizing a fluid to launch and impart rapid momentum to a toy vehicle, and which can be operated repeatedly yet reliably.

SUMMARY OF THE INVENTION

It is an object of the invention to provide a means for utilizing a fluid to power and launch a toy vehicle to travel at a high rate of speed.

It is a further object of the invention to provide a means for repeatedly and reliably so powering and launching a toy vehicle.

According to preferred embodiments of the present invention, pressurized fluid powers and launches a toy vehicle. In a first preferred embodiment a system simultaneously directs compressed fluid to a turbine while compressing fluid to disengage a locking mechanism that restrains movement of the toy vehicle. In that first preferred embodiment a primary tube, attached to the toy vehicle, forms a primary chamber which receives a secondary tube that seals the primary chamber. A fluid may be compressed into the primary chamber through the inserted tube. The interior of the inserted tube forms a secondary chamber which encases a hollow piston. Fluid is compressed into the primary chamber and secondary chamber through the hollow piston. The hollow piston also forms a part of a locking mechanism which maintains a latch, the primary tube and the secondary tube in contact with one another until pressurized fluid in the primary chamber forces the piston away from the latch. As the latch disengages, pressurized fluid from the primary chamber forces the secondary tube from the primary tube. The hollow piston, secondary tube and primary tube have openings which together form a pathway for fluid to pass to a conduit on the chassis of the toy vehicle. The conduit directs fluid to a turbine wheel which in turn is connected to flywheels which provide power to the wheels of the toy vehicle.

In a second preferred embodiment of the invention a system first directs a stored quantity of compressed fluid to a turbine mounted upon a toy vehicle. Then, to launch the toy, the system directs a burst of compressed fluid in opposition to the chassis of the toy vehicle. A coaxial conduit arrangement is used for driving the turbine and for directing the launching burst of fluid. As a means for performing the two-step power-launch sequence the second preferred embodiment also provides a reservoir for receiving and storing compressed fluid and then channeling the stored compressed fluid to the turbine while simultaneously enabling a short burst of compressed fluid to be directed to the vehicle chassis.

Other aspects, objects, features, and advantages of the present invention will become apparent to those skilled in the art upon reading the detailed description of preferred embodiments.

DETAILED DESCRIPTION OF PREFERRED EMBODIMENTS OF THE INVENTION

While the specification concludes with claims particularly pointing out and distinctly claiming the subject matter which is regarded as the present invention, the invention will now be described with reference to the following description of embodiments taken in conjunction with the accompanying drawings.

The invention provides a turbine-powered toy vehicle which is powered and launched by a pneumatic system. In a first preferred embodiment launching of the vehicle is achieved automatically during the powering cycle. In a second preferred embodiment powering and launching are accomplished in a two-step cycle.

Figure 1:
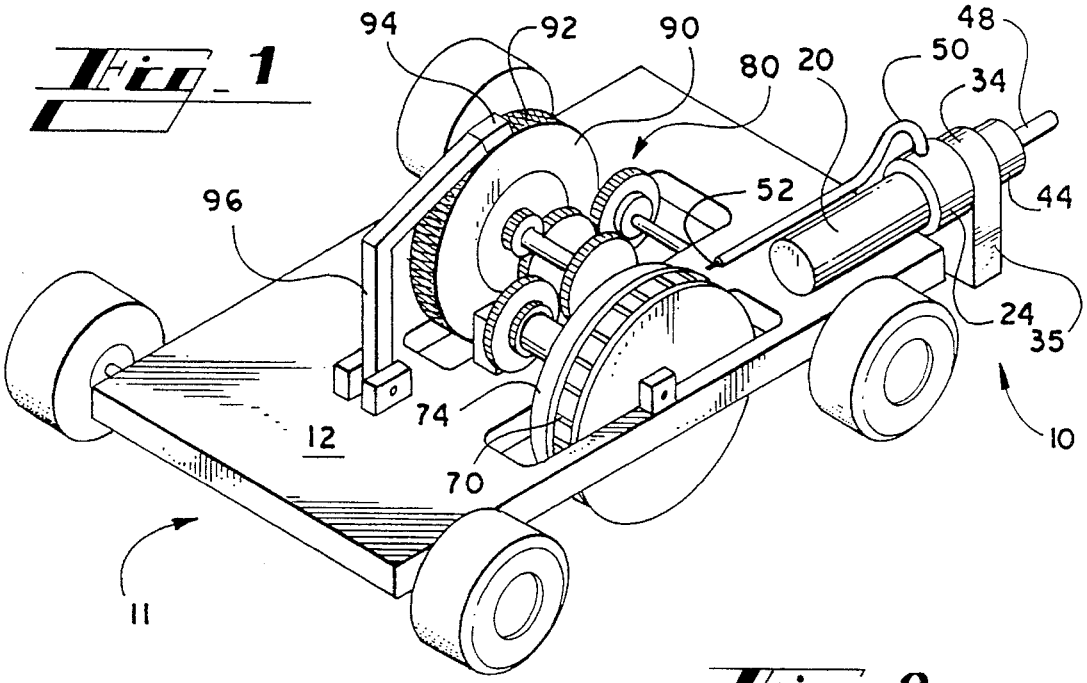
FIG. 1 is an isometric illustration of a system for powering and launching a toy vehicle according to a preferred embodiment of the invention.

Referring first to FIG. 1, a turbine-powered toy vehicle in a system for powering and launching a toy vehicle by means of a fluid 10 according to a preferred embodiment of the invention is illustrated. The top of the toy vehicle 11 has been removed to reveal the key elements of the system 10 and vehicle 11. A primary tube 20 having a flanged end 24 is shown attached to the chassis 12. The flange 34 of a secondary tube 30 inserted in the primary tube 20 is shown adjacent the flange 24 of the primary tube 20. A support (not shown) is attached to the flange 34 of the secondary tube. The flange 44 and shaft 48 of a hollow piston are shown adjacent the flange 34 of the secondary tube. A turbine tube 50 and nozzle 52 extend from the primary tube 20 and are directed at the vanes 72 of a turbine wheel 70. The turbine wheel 70 is connected to a primary flywheel 74. The primary flywheel 74 is connected by an assembly of gears 80 to a secondary flywheel 90. The secondary flywheel 90 has an abraded rim 92 upon which rests a piece of flint 94. The flint 94 is held in place by a spring-loaded mechanism 96. Although flint may be engaged by a separate abrasion wheel placed in the gear train, the utilization of at least one of the flywheels of the system to produce the flying-sparks effect reduces the number of elements used to produce the vehicle and system.

Figure 2:
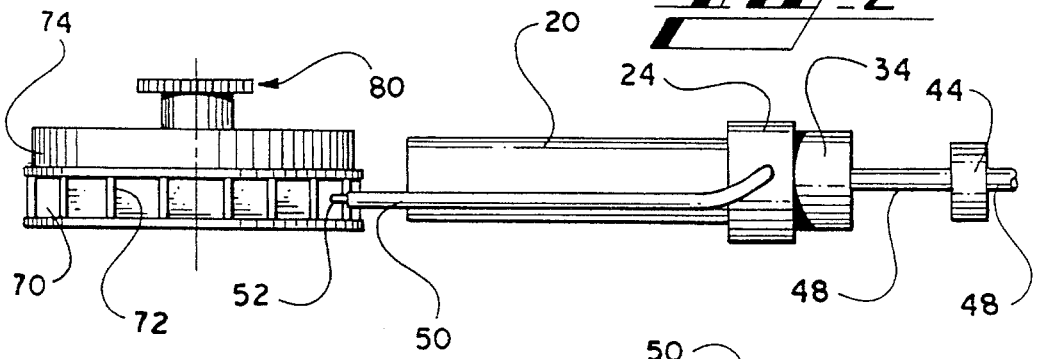
FIG. 2 is a top plan view of the primary elements of the invention of FIG. 1.

Referring now to FIG. 2, a top plan view further illustrates the alignment of the primary tube 30, its flange 24, the flange 34 of the secondary tube inserted in the primary tube 20, and the flange 44 and shaft 48 of the hollow piston. The hollow piston is shown in an extended position withdrawn from the flange 34 of the secondary tube. The alignment of the turbine tube 50, turbine wheel 70, primary flywheel 74 and first gear of the gear assembly 80 is also shown.

Figure 3:
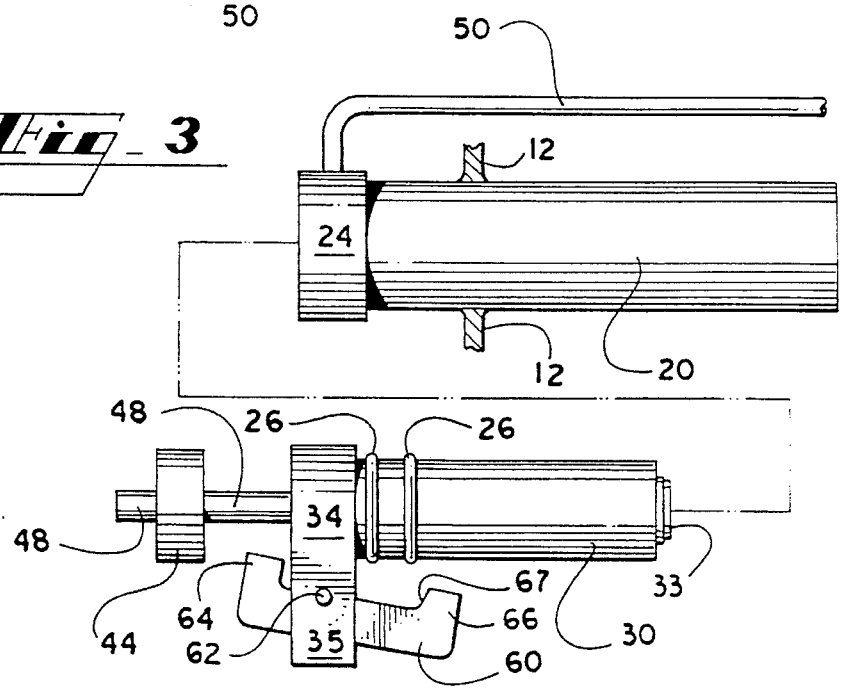
FIG. 3 is an exploded elevational illustration of the primary components of the system of FIG. 1.

Referring now to FIG. 3, the major elements of the system 10 of FIG. 1 are illustrated in an exploded, partial side elevational view. The primary tube 20 is attached to the chassis 12 of the toy vehicle. The turbine tube 50 extends from the flange 24 of the primary tube 20. The secondary tube 30 is shown to be insertable into but removed from the primary tube 20. A check valve 30 (flap) is partially secured over the end of the secondary tube 30. A pair of O-rings encircle the secondary tube 30 to provide a seal between the primary tube 20 and the secondary tube 30. A flange 34 is formed around the rear end of the secondary tube 30 and has a support base 35 attached thereto. The secondary tube 30 houses a piston whose shaft 48 is shown extending from the secondary tube 30 and whose flange 44 is shown around its shaft 48. The support base 35 is shown formed with and extending from the flange 34 of the secondary tube 30. A latch 60 is attached to the support base 35 through a pivot 62. The rear end of the latch 60 is shown pivoted upward in a disengaged position with respect to the flange 44 of the piston which it abuts during engagement of the lock. The front end 66 of the latch 60 is shown pivoted downward with its bevelled edge 67 clearly shown.

Figure 4:
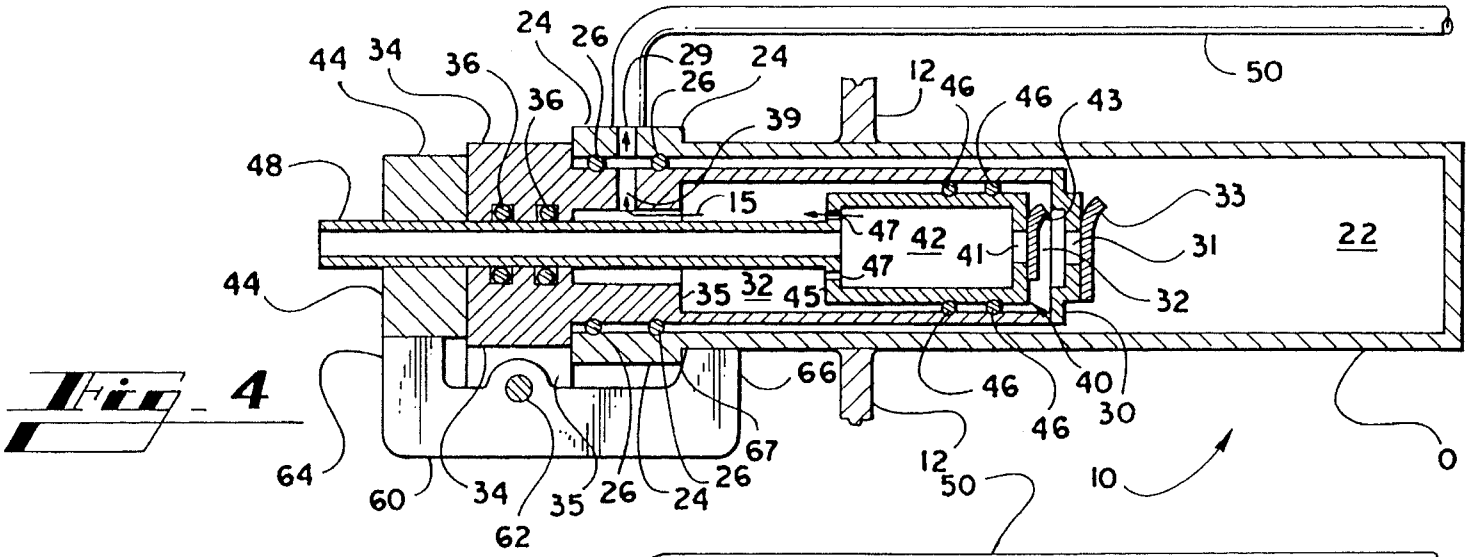
FIG. 4 is a sectional illustration of the system of FIG. 1 shown with the locking mechanism engaged.

Referring now to FIG. 4, therein is illustrated in a sectional side elevation view of the elements of the system for powering and launching a toy vehicle 10 of FIG. 1. A primary tube 20 is attached to the chassis 12 of the toy vehicle. The primary tube 20 forms a chamber 22. As previously mentioned, a turbine tube 50 extends from the flange 24 of the primary tube. The turbine tube 50 is aligned over a bore 29 transversely extending through the flange 24 of the primary tube. A secondary tube 30 is inserted into the primary tube 20 and securely yet removably sealed in place by means of O-rings 26. The secondary tube 30 forms a chamber 32. An aperture 31 at the front end of the secondary tube 30 is covered by a partially-secured flap 33 which serves as a check valve. A flange 34 is formed at the rear end of the secondary tube 30. A bore 39 transversely extending through the flange 34 of the secondary tube 30 is positioned to be in alignment with the bore 29 of the primary tube 20 when the secondary tube 30 is inserted into the primary tube 20. A support base 35 is attached to the flange 34 of the secondary tube 30. The secondary tube 30 encases a hollow piston 40. Like the primary 20 and secondary 30 tubes, the hollow piston forms a chamber 42. An aperture extends through the front end of the hollow piston 30, that is, through the head 45 of the hollow piston 40 from its chamber 42 to the chamber 32 of the secondary tube. A flap 43 partially secured to the head, or body, 45 of the piston 40 serves as a check valve for the chamber 42 of the piston 40. A flange 44 is formed at the rear end of the piston 40 around a hollow piston rod 48. The piston rod 48 extends through the flange 34 of the hollow tube 30. A set of O-rings seals 36 the juncture between the piston rod 48 and the secondary tube 30. Another set of O-rings seals the juncture between the inside wall of the secondary tube and the outer wall of the body 45 of the piston 40. The locking mechanism is formed by a latch 60 which is attached by means of a pivot 62 to the support base 35 of the secondary tube 30. The rear end 64 of the latch 60 is shown abutting the flange 44 of the piston 40. The front end 66 of the latch 60 engages the edge of the flange 24 of the primary tube 20 thus maintaining the primary 20 and secondary 30 tube in contact with one another. The inner edge 67 of the front end 66 of the latch is bevelled for easy disengagement of the inner edge 67 and flange 24 when the latch 60 is to be released.

Figure 5:
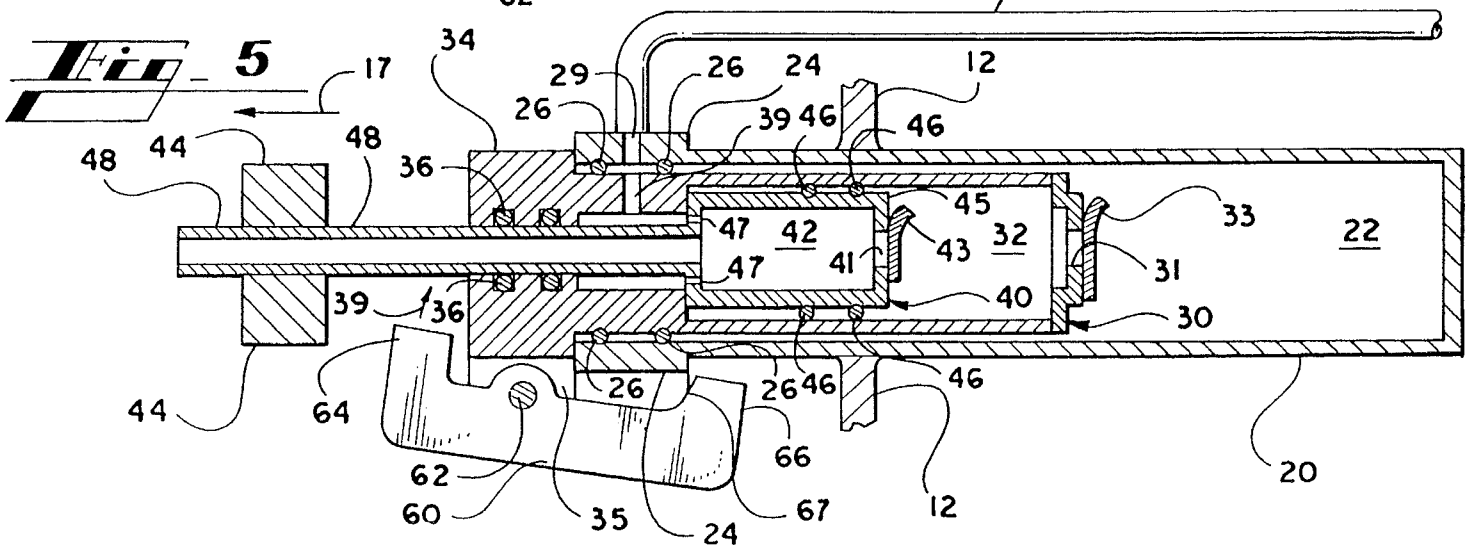
FIG. 5 is the same sectional illustration as shown in FIG. 4 but with the locking mechanism of the system disengaged.

Referring now to FIG. 5, therein is shown the same elements of the system 10 as discussed with respect to FIG. 4 but with the piston 40 in a retracted position with respect to the chamber 32 of the secondary tube 30 and with the latch 60 in a disengaged, inclined position.

To initiate operation of the system the secondary tube 30 is pushed into the primary tube 20 and the piston is pushed forward into the secondary tube until the flange 44 of the piston 40 abuts the rear end of the secondary tube 30. At the same time, the front end 66 of the latch 60 is pivoted upward such that the bevelled engagement edge 67 of the front end 66 of the latch 60 engages the flange 24 of the primary tube 20. The flange 44 of the secondary tube 40 holds the latch 60 in place by abutting the rear end 64 of the latch 60.

The system 10 operates on the principles of fluid compression and flow. Fluid is pumped into the system 10 by any convenient means, such as a simple bicycle pump or compressed air hose, through the hollow shaft 48 of the piston 40. The system 10 has two paths of fluid flow; one path directs fluid to operate a turbine while the second path automatically releases a locking mechanism over a short period of time. The system 10 of FIG. 1 enables fluid flow to be used to "power up" the toy vehicle and then release the toy vehicle after a short period of mechanical energizing. The path of fluid flow to the turbine tube 50 is from the chamber 42 of the hollow piston 40, through the apertures at the rear of hollow head 45 of the piston 40, through the rear portion of the chamber 22 of the primary tube 30, through the transverse bore 39 in the wall of the secondary tube 30, and through the transverse bore 29 of the flange 24 of the primary tube 20. The fluid flow through this path is illustrated by the direction arrows 15 in FIG. 4. The fluid flowing through this path provides mechanical energy that rapidly turns the turbine wheel 70 and primary flywheel 74 which is attached to the turbine wheel 70. When the secondary tube 30 is inserted in the primary tube 40, the wheels of the toy vehicle 11 are held lifted from the resting surface for the toy vehicle 11 by the support base 35. When fluid is pumped into the system 10 through the hollow shaft 48 it first enters the chamber 42 of the piston 40. Upon filling the piston chamber 42 the fluid then pushes open the piston's check valve 43 and flows into the chamber 32 of the secondary tube 30. Upon filling the secondary-tube chamber 32 the fluid pushes open the secondary-tube check valve 33 and flows into the primary-tube chamber 22. As the primary-tube chamber 22 fills, the fluid in that chamber 22 is compressed. The compressed fluid closes off the check valve 33 of the secondary tube and pressurizes the chamber 22. When the chamber 22 becomes pressurized, pressure generated by the compressed fluid is exerted against the secondary-tube check valve 33, causing it to seal off the aperture 31 of the secondary tube. The pressure force generated by the compressed fluid in the primary-tube chamber 22 is also exerted against secondary tube 30, attempting to force it out the of primary tube 20. When the secondary-tube check valve 33 seals off the aperture 31, the secondary-tube chamber 32 becomes pressurized by the fluid. Pressurization of the fluid in the secondary-tube chamber 32 causes fluid pressure to be exerted against the piston head 45, closing the piston check valve 43 and forcing the piston 40 back through the opening at the rear of the secondary tube 30. During the period that the primary 22 and secondary chambers 32 are being filled fluid continues to flow through the apertures 47 at the rear of the piston head 45 to the turbine tube 50. The nozzle 52 of the turbine tube 50 directs pressurized fluid into the vanes 72 of the turbine wheel 70 causing the turbine wheel 70 and ultimately the wheels of the vehicle 11 to turn at a rapid rate. As the turbine wheel 70 turns sparks fly from the flint 94 held against the abraded rim 92 of the secondary flywheel 90. The sparks from the flint 94 create an exciting effect, especially in conjunction with the sound resulting from the turbine. The flywheels 74, 90 gather and maintain momentum during the period that the chambers 22, 32 are being pressurized. Although one flywheel 74 or 90 may be used to provide the momentum to turn the wheels of the vehicle 11, the use of a second flywheel revolving in a direction opposite the direction of revolution of the first flywheel cancels out the gyroscopic effect of a single vertically-oriented flywheel that may cause the vehicle 11 to veer or tilt during travel. The wheels of the vehicle 11 turn freely until launching because they are held elevated above the resting surface by the support base 35.

Although pressurization of the primary-tube chamber 22 attempts to force the secondary tube 20 from the primary tube 30 the two tubes 20, 30 are held in place by the latch 60. When the piston moves rearward, the rear end 64 of the latch 60 is disengaged and the latch is allowed to pivot about the pivot point 62. The latch 60 is designed with a greater length extending from the pivot point 62 to the front portion of the latch 60 so that gravity will cause the front end 66 to pivot downward when the rear portion 64 is freed. In addition, the front portion 66 of the latch 60 is also forced downward by the downward component of the force of the primary tube flange 24 acting upon the downwardly-inclined edge 67 of the latch as the primary 20 and secondary 30 tubes attempt to separate from one another. When the latch 60 disengages, the primary 20 and secondary 30 tubes are allowed to separate and the primary tube 20 and the vehicle 11 to which it is attached are launched from the suspended position. The vehicle 11 contacts the surface with its wheels turning rapidly.

The set of O-rings 26 between the primary 20 and secondary 30 tubes seals the chamber 22 of the primary tube 20. The set of O-rings between the inside wall of the secondary tube 30 and the outer wall of the body 45 of the piston 40 seals the front portion of the chamber 32 of the secondary tube 30 that is adjacent the aperture 41 at the front end of the secondary tube 30. The set of O-rings 36 between the piston rod 48 and the secondary tube 30 seals the portion of the chamber 32 of the secondary tube 30 that is at the rear of the secondary tube from which fluid flows 15 through the transverse bore 39.

The piston 40 does not move rearward until the primary-tube chamber 22 and the secondary-tube chamber 32 become pressurized. During the period while these two chambers 22, 32 are becoming pressurized, fluid is flowing to and through the turbine tube 50 causing the turbine wheel 70 and adjoining drive train components to revolve. The system 10 thus runs a turbine engine, powering up the momentum wheels 74, 90 during the period of pressurization of the chambers 22, 32.

Figure 6:
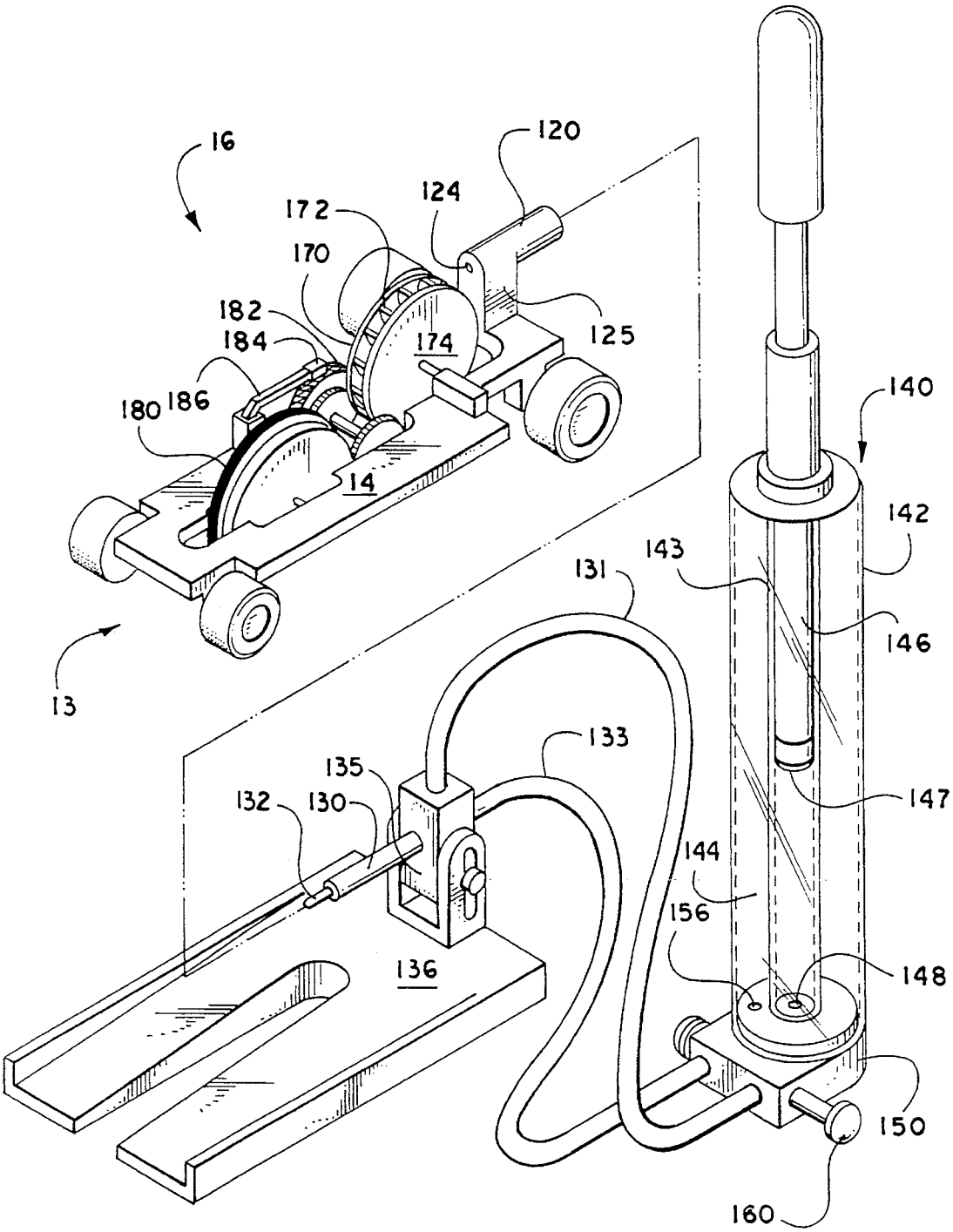
FIG. 6 is an isometric illustration of a system for powering and launching a toy vehicle according to a second preferred embodiment of the invention.
Figures 7, 8, 9, 10:
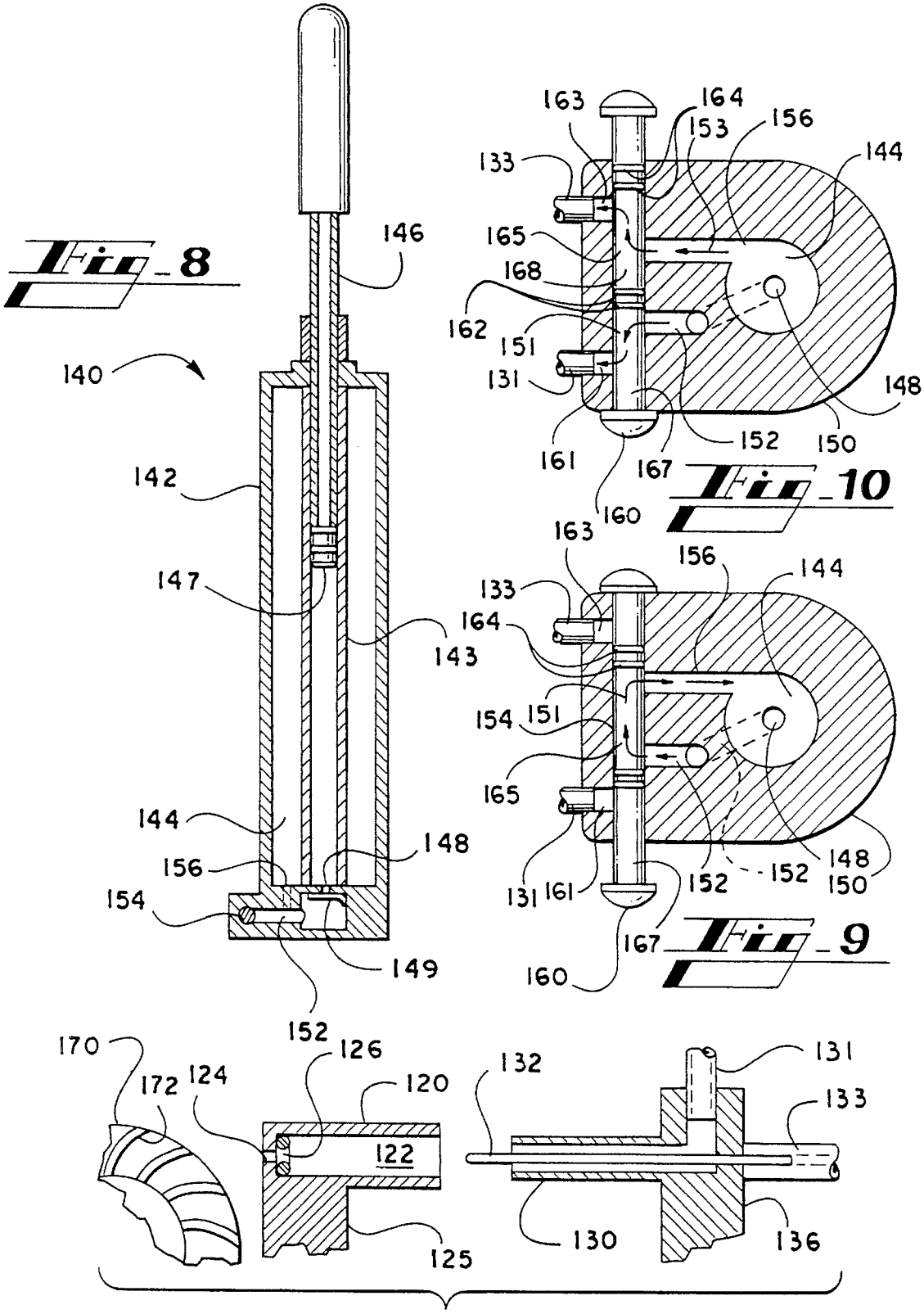
FIG. 7 is a partial side elevation sectional view of the system of FIG. 6 showing several components of the system.
FIG. 8 is a side elevation sectional view of a portion of the system of FIG. 6 which receives and conducts compressed fluid to the toy vehicle.
FIG. 9 is a sectional illustration of the base of the fluid-compression-and-storage portion of the system of FIG. 6 illustrating the system in a fluid-storage mode.
FIG. 10 is the same sectional illustration as FIG. 9 but showing the system in a mode for discharging the reservoir and directing a launching burst of fluid.

In a second preferred embodiment, a turbine of the toy vehicle may be mechanically energized from a reservoir of stored compressed fluid and may be launched by means of a burst of fluid pressure separately applied. Referring now to FIG. 6, therein is illustrated a system for powering and launching a toy vehicle by means of a fluid 16 according to a second preferred embodiment of the invention. The system 16 employs components to first store compressed fluid in a reservoir then release the stored fluid to a turbine while at the same time direct a burst of compressed fluid to the toy vehicle 13 in order to launch it. Referring now also simultaneously to FIG. 7, a coaxial conduit arrangement is used to direct the powering and launching fluids to essentially the same position on the toy vehicle 13. A primary tube 120 positioned adjacent a turbine wheel 170 forms the outer conduit of the coaxial conduit arrangement. An aperture 124 is formed at the end of the primary tube 120 for passage of a turbine tube that directs fluid to the turbine wheel 170. The primary tube 120 is attached to and supported upon the chassis by a support member 125. The main components on the toy vehicle 13 are identical to the features on the toy vehicle described above, namely, the turbine wheel 170, the vanes 172 of the turbine wheel 170, a primary flywheel 174, a secondary flywheel 180 and gears interconnecting the two flywheels 174, 180. As discussed above, a sparking effect may be produced by the use of a piece of flint held against a rotating abrasive surface. To illustrate the alternative use of an abrasion wheel distinct from a flywheel, an abrasion wheel 182 is shown in connection with the gear train. Flint 184 is held against the abrasion wheel by a spring-loaded holder 186. A secondary conduit 130 is sized to closely fit within the primary conduit 120. A turbine tube 132 extends from the end of the secondary tube 130. The secondary tube 130 is formed with and supported by a support member 135. A conduit 131 to the turbine tube 132 and a conduit 133 to the secondary tube 130 are channeled through the secondary-tube support member 135. The secondary-tube support member 135 is pivotably mounted upon a base 136. Referring now also to FIG. 8, compressed fluid is channeled through the system 16 from a reservoir-and-valve assembly 140. The reservoir-and-valve assembly 140 shown also conveniently contains a pumping mechanism. Distinct reservoir and pump chambers are defined by respective reservoir 142 and pump 143 tubes. Although an external pump may be used to direct compressed air to the system 16 the self contained pump is convenient. The pump mechanism of the reservoir-and-valve assembly 140 consists of the pump tube 143 through which a plunger 146 may reciprocate. The plunger 146 is a hollow tube through which fluid may enter the pump tube 143 by passing through the hollow plunger 146 past the pump check valve 147 into the pump tube 143. Fluid compressed at the bottom of the pump tube 143 passes through an aperture 148 located at the bottom of the sealed off pump tube 143. The reservoir tube 142 and pump tube 143 are supported by a reservoir-and-valve assembly base 150 which contains integrally-formed conduits and a valve 160 for directing fluid flow. An aperture which leads to a reservoir conduit 156 is formed upon the reservoir-and-valve assembly base 150 at the bottom of the reservoir tube 142. A conduit for the secondary tube 131 and a conduit for the turbine tube 132 interconnect the reservoir-and-valve assembly 140 and the secondary-tube support member 135.

Referring now to FIG. 9, a cross-sectional view through the reservoir-and-valve assembly base 150 shows the cooperation between the reservoir 144, connecting conduits 152, 154, 156, valve 160 and fluid ports 161, 163. The aperture 148 from the pump tube 143 leads into a pump-tube conduit 152 formed in the base 150. The pump-tube conduit 152 in turn leads to a valve conduit 154. The valve conduit 154 leads to a reservoir conduit 156 which, in turn, leads to the compressed-fluid reservoir 144. A pair of valve seals 162, 164 segregate a middle open portion 165 of the valve and an end open portion of the valve 160. The valve is shown placed in the "storage" position wherein the middle open portion 165 of the valve 160 connects the pump-tube conduit 152 and the reservoir conduit 156, allowing fluid to be stored under compression in the reservoir 144. In this valve position, the seals 162, 163 of the valve 160 prevent fluid from flowing to either the turbine 161 or exhaust 163 port.

Referring now to FIG. 10, the valve 160 is shown moved to the "discharge" position wherein the middle open portion 165 of the valve 160 connects the reservoir conduit 156 to the turbine port 163 and the end open portion 167 of the valve 160 connects the pump-tube conduit 152 to the secondary-tube (launching) port 161.

The toy vehicle 13 is initially mounted upon the secondary tube support member 135 which holds wheels of the toy 13 elevated above the base 136. This is accomplished by sliding the primary tube 120 over the secondary tube 130. The two tubes 120, 130 are pushed together until the turbine tube 132 extends through the aperture 124 in the primary tube 120 and the secondary tube 130 is seated against the O-ring 124. The valve 160 is placed in the storage position of FIG. 9, as described above, and compressed fluid (air in particular) is pumped into the reservoir 144 as illustrated by the direction arrows 151. When the reservoir has stored a quantity of fluid sufficient to turn the turbine wheel 170 at a desired high speed, the valve is "opened" to the position shown in FIG. 10 and fluid is allowed to flow from the reservoir 144 to the turbine port 163 as illustrated by the direction arrows 154 shown. When the valve 160 is opened, the pump conduit 152 is then connected to the secondary-tube/launch port 161. The turbine is powered by the flow of compressed fluid from the reservoir 144. A blast from the pump will direct a burst of compressed fluid against the O-ring 126 and the end of the primary tube 120, "launching" the vehicle 13 from its support 135.

Figure 12:
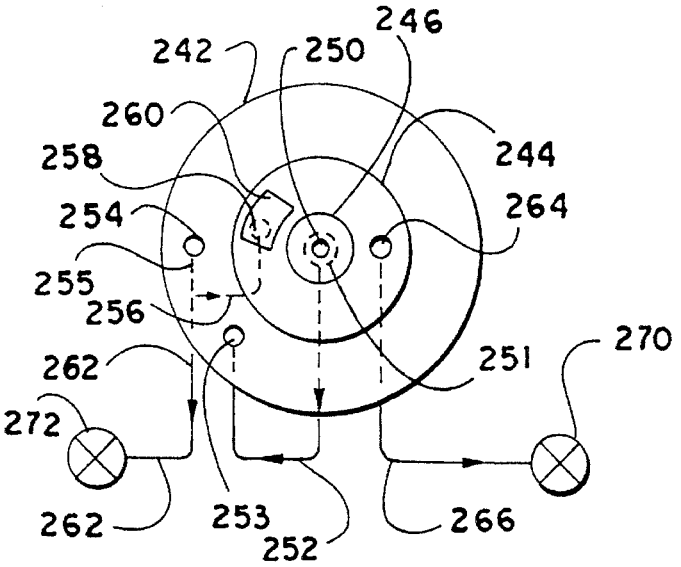
FIG. 12 is a schematic illustration of the internal conduit arrangement for the fluid-compression-and-storage assembly of the system of FIG. 12.
Figure 11:
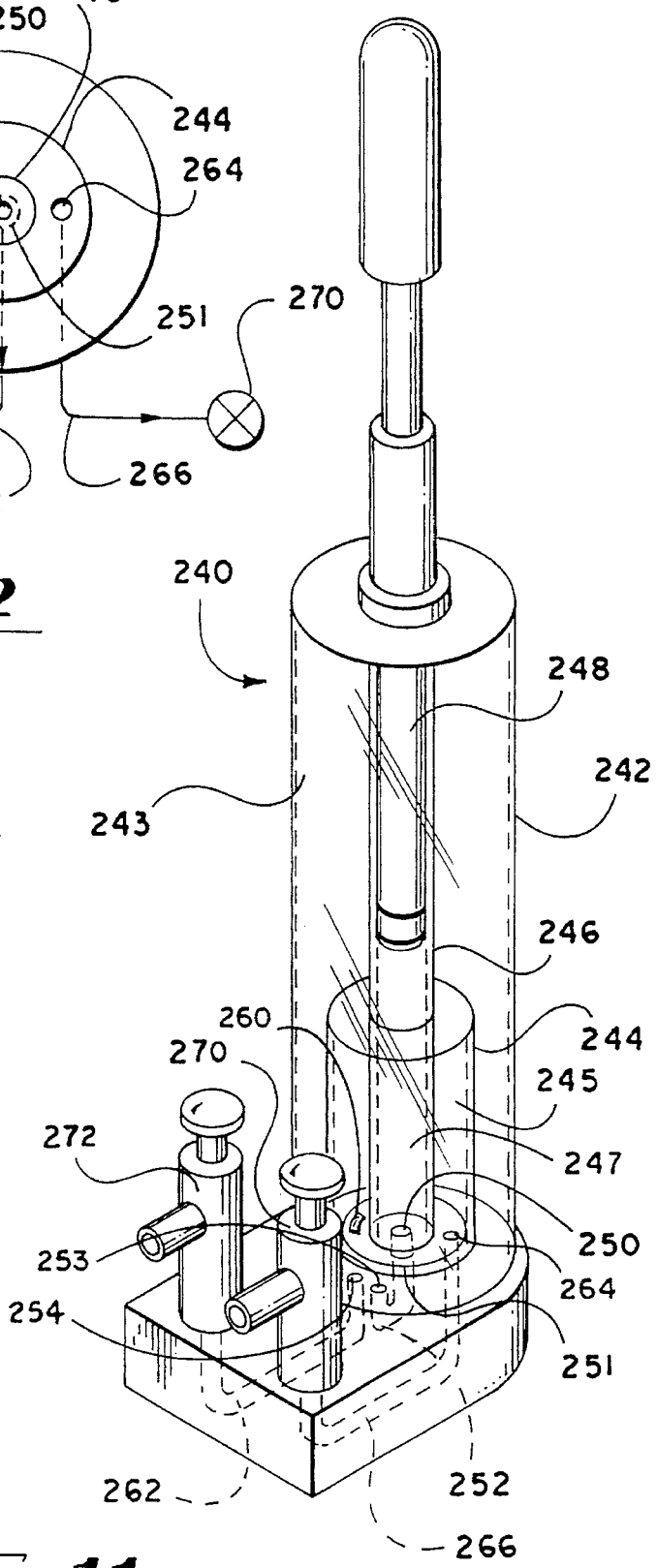
FIG. 11 is an isometric illustration of an alternate embodiment of the fluid-compression-and-storage assembly of the system of FIG. 6.

Referring now to FIG. 11, an alternate embodiment of a reservoir-and-valve assembly 240 for use with the system of FIG. 6 is shown. In this alternate embodiment a flow of pressurized fluid is again provided by a reservoir but the burst of pressurized fluid is provided by a secondary reservoir (or chamber). Concentrically-arranged tubes 242, 244, 246 provide respective distinct primary reservoir/chamber 243, secondary reservoir/chamber 245, and pump chamber 247 for the pump. The largest chamber, the primary reservoir/chamber 243, is formed between the primary reservoir tube 242 and secondary reservoir tube 244. The secondary reservoir/chamber 245 is formed between the secondary reservoir tube 244 and the pump tube 246. Referring now also to FIG. 12, the internal conduit arrangement of the base of the reservoir-and-valve assembly 240 is illustrated in a schematic format for explanation. Fluid exits the pump tube chamber 247 through an aperture 250 regulated by a check valve 251. The fluid travels by conduit 252 from the pump chamber 247 into the primary reservoir chamber 243 through an aperture 253. Fluid exits the primary reservoir chamber 243 through an aperture 254 and conduit 255. Fluid flowing through the exit conduit 255 of primary chamber 243 may take a path through another conduit 256 through an aperture 258 into the secondary reservoir/chamber 245. The secondary chamber 245 is regulated for pressurization by the check valve 260 over the entrance aperture 258. Compressed fluid exits the secondary chamber 245 through an aperture 264 to a conduit 266 which leads to a port-valve 270. The port-valve 270 is connectable to the secondary-tube conduit 131 of the system 16 described above. Fluid exiting the primary reservoir 243 through the exit conduit 255 may travel through a conduit 262 to a port-valve 272 which is connectable to the turbine-tube conduit 133 of the system 16 described above. In operation, as the plunger 248 of the pump is reciprocated fluid is directed into the primary chamber 243 where it then exits and travels to the secondary chamber 245 where it becomes compressed. When the fluid in the secondary chamber 245 becomes pressurized the closed check valve 260 causes the fluid in and entering the primary chamber 243 to become pressurized. Once the primary chamber 243 is also pressurized the port-valves 272, 270 may be operated to direct compressed fluid respectively first to the turbine tube 132 as previously described, and then to the secondary tube 130, also as previously described.

As should be apparent from the foregoing specification, the invention is susceptible of being modified with various alterations and modifications which may differ from those which have been described in the preceding specification and description. Accordingly, the following claims are intended to cover all alterations and modifications which do not depart from the spirit and scope of the invention. For example, the system 10 is described in terms of operation by means of a fluid flow. Although air is the most readily available and inexpensive fluid that can be used to operate the system 10 and is the medium which works well in the preferred embodiment, other gases and even water may be used. As previously mentioned, the system 10 works on the basis of principles of fluid compression and flow. Thus, any fluid, that is compressible and flowable is generally suitable. Air and other gases are generally more suitable for use than liquid fluids because gases dissipate quickly into air and don't have to be removed from the vicinity of the toy vehicle as in the case of a liquid such as water. As a further example of a modification which conforms to the preferred embodiments described herein, the vehicle is illustrated as a car or similar wheeled vehicle, however, the invention encompasses the use of any vehicle, such as a flying vehicle propelled by a propeller, whose propulsion means (wheels or propeller) may be mechanically energized and "revved up" by a turbine.

What is claimed is:

1. A system for powering and launching a toy vehicle comprising:

a vehicle body having a drive train for engaging propulsion means thereof;

a turbine wheel connected to said vehicle body operably communicating with said drive train;

a housing attached to said vehicle body defining a chamber for receiving a fluid;

means for receiving and pressurizing said chamber with said fluid;

means for directing said fluid to said turbine wheel as said chamber is pressurized;

means for suspending said vehicle body in a position which prohibits movement; and self-actuating means for automatically releasing said vehicle body from said suspended position which, also, prohibits movement when said chamber becomes pressurized with said fluid, said self actuating means being the chamber operatively associated with a latch means which is activated by said fluid when pressurized in order to release said vehicle from said means for receiving and pressurizing upon attainment of sufficient pressure within said chamber.

2. A system for powering and launching a toy vehicle comprising:

a vehicle body having a drive train for engaging propulsion means thereof;

a turbine wheel, having vanes, connected to said vehicle body operably communicating with said drive train;

a housing attached to said vehicle body defining a first chamber for receiving a fluid defining an opening disposed in a first direction opposite a second direction of desired travel for said vehicle body;

a plug member adapted for being closely received in releasable fluid-tight engagement by said opening of said housing such that said housing and said plug member are forcibly repelled from one another when said first chamber becomes pressurized by said fluid, said plug member defining a second chamber for receiving said fluid, having means for permitting said fluid to flow from said second chamber into said first chamber until said first chamber becomes pressurized, said plug member also defining first means for directing said fluid under pressure through a first aperture into said second chamber;

support means adapted for suspending said vehicle body in a position which prohibits movement when said housing and said plug member are engaged with one another;

a turbine tube extending from said housing terminating in a nozzle directed toward said vanes of said turbine wheel;

second means for directing said fluid under pressure from said second chamber through said housing into said turbine tube; and self-actuating means for preventing said housing and said plug member from being forcibly repelled from one another until both said first chamber and said second chamber become pressurized.

3. A system for powering and launching a toy vehicle comprising:

a vehicle body having a drive train for engaging propulsion means thereof;

a turbine wheel, having vanes, connected to said vehicle body operably communicating with said drive train;

a housing attached to said vehicle body defining a first chamber for receiving a fluid, defining an opening disposed in a first direction opposite a second direction of desired travel for said vehicle body and having a housing flange adjacent said opening thereto;

a plug member adapted for being closely received in releasable fluid-tight engagement by said opening of said housing such that said housing and said plug member are forcibly repelled from one another when said first chamber becomes pressurized by said fluid, defining a second chamber for receiving said fluid, having means for permitting said fluid to flow from said second chamber into said first chamber until said first chamber becomes pressurized, and defining a first aperture at an end thereof which protrudes from said housing;

a turbine tube extending from said housing terminating in a nozzle directed toward said vanes of said turbine wheel;

support means adapted for suspending said vehicle body in a position which prohibits movement when said housing and said plug member are engaged with one another;

a piston member reciprocally encased within said second chamber adapted for being closely received in slidable fluid-tight engagement within said second chamber having a piston head defining a third chamber, having a piston rod extending from said piston head through said first aperture of said plug member defining a bore therethrough opening into said second chamber adapted for being closely received in slidable fluid tight engagement by said first aperture of said plug member and having a piston flange disposed around said shaft thereof positioned such that said piston flange abuts said end of said plug member which protrudes from said housing when said piston is in a forwardmost position within said second chamber;

means for directing said fluid into said turbine tube as said first and second chambers become pressurized; and a U-shaped member pivotably affixed to said support means proximate said end of said plug member which protrudes from said housing such that when said piston member is fully inserted within said second chamber a first leg of said U-shaped member abuts said piston flange and a second leg of said U-shaped member engages said housing flange so as to maintain said plug member inserted within said opening of said housing and such that when said piston flange translates rearward to a non-abutting position with respect to said first leg said first leg pivots upward and said second leg pivots downward disengaging said housing flange.

4. The system according to claim 3, wherein said second leg has a bevelled edge which engages said housing flange.

5. The system according to claim 3, said means for directing said fluid into said turbine tube as said first and second chambers become pressurized comprising:

a second aperture transversely extending through said housing in alignment with an opening to said turbine tube;

a third aperture transversely extending through said plug member disposed such that said third aperture is in axial alignment with said second aperture when said plug member is inserted within said housing; and said piston member having means for preventing said fluid from passing between a front of said piston head and a rear of said piston head and having at least one fourth aperture positioned to permit said fluid to flow into a portion of said second chamber rearward of said means for preventing said fluid from passing between a front of said piston head and a rear of said piston head.

6. The system according to claim 3, wherein said fluid is a gas.

7. The system according to claim 5, wherein said gas is air.

8. The system according to claim 3, wherein said vehicle is a wheeled vehicle and said propulsion means comprise wheels.

9. The system according to claim 3, wherein said drive train includes at least one fly wheel.

10. The system according to claim 3, wherein said drive train includes two oppositely-revolving flywheels.

11. The system according to claim 3, wherein a rim of said at least one flywheel is abraded and a flint member is disposed in spring-loaded contact therewith.

12. A system for powering and launching a toy vehicle comprising:

a vehicle body having a drive train for engaging propulsion means thereof;

a turbine wheel, having vanes, connected to said vehicle body operably communicating with said drive train;

a first tubular member attached to said vehicle body defining a first bore, defining an opening disposed in a first direction opposite a second direction of desired travel for said vehicle body and defining a first aperture disposed adjacent said vanes of said turbine wheel;

a compressed fluid assembly having;

a second tubular member having an outer wall for being closely received by said first bore of said first tubular member and defining a second bore;

a turbine tube having a first end terminating in a nozzle;

support means connected to said second tubular member defining a first conduit for receiving and directing a first fluid flow to said second bore of said second tubular member, defining a second conduit for receiving and supporting said turbine tube in coaxial alignment in said second tubular member such that said nozzle of said turbine tube projects from said second tubular member and a second end of said turbine tube may receive a second fluid flow, and for suspending said vehicle body in a position which prohibits movement when said first tubular member and said second tubular member are coaxially engaged with one another;

means for receiving a pumped fluid, a reservoir for receiving said pumped fluid and maintaining said pumped fluid under pressure, first port means, second port means, conduit means interconnecting said means for receiving a pumped fluid, said reservoir, said first port means, and said second port means, and valve means adapted for movement between a first position wherein said means for receiving a pumped fluid is connected with said reservoir and a second position wherein said means for receiving a pumped fluid is connected with said first port means and said reservoir is connected with said second port means;

first fluid conducting means connecting said first conduit of said support means and said first port means; and second fluid conducting means connecting said turbine tube and said second port means; and wherein said vehicle body may be engaged suspended above a surface upon which said support means rests by inserting said second tubular member within said first bore of said first tubular member with said turbine tube projecting through said first aperture of said first tubular member.

13. A system for powering and launching a toy vehicle according to claim 12, further comprising means adjacent said first aperture of said first tube for providing a seal between said first aperture and said turbine tube.

14. A system for powering and launching a toy vehicle according to claim 12, wherein said fluid is a gas.

15. A system for powering and launching a toy vehicle according to claim 14, wherein said gas is air.

16. A system for powering and launching a toy vehicle according to claim 12, wherein said toy vehicle is a wheeled vehicle and said propulsion means comprise wheels.

17. A system for powering and launching a toy vehicle according to claim 12, further comprising a base for supporting said support means and wherein said support means is pivotable with respect to said base.

18. A system for powering and launching a toy vehicle according to claim 12, wherein said drive train includes at least one flywheel.

19. A system for powering and launching a toy vehicle according to claim 12, wherein the drive train includes two oppositely-revolving flywheels.

20. The system according to claim 12, wherein a rim of said at least one flywheel is abraded and a flint member is disposed in spring-loaded contact therewith.

21. The system according to claim 12, said drive train further comprising an abrasion wheel and said vehicle body having a flint member disposed in spring-loaded contact with said abrasion wheel.

* * * * *